US011536037B1

(12) United States Patent
Cheng

(10) Patent No.: US 11,536,037 B1
(45) Date of Patent: Dec. 27, 2022

(54) VERSATILE DRYWALL COMPOUND TOOL

(71) Applicant: Allway Tools Inc., West Babylon, NY (US)

(72) Inventor: Yuan Fang Cheng, Syosset, NY (US)

(73) Assignee: Allway Tools Inc, Bronx, NY (US)

( * ) Notice: Subject to any disclaimer, the term of this patent is extended or adjusted under 35 U.S.C. 154(b) by 0 days.

(21) Appl. No.: 17/338,723

(22) Filed: Jun. 4, 2021

(51) Int. Cl.

| | |
|---|---|
| ***E04F 21/06*** | (2006.01) |
| ***E04F 21/165*** | (2006.01) |
| ***B25G 1/10*** | (2006.01) |
| ***B25G 3/26*** | (2006.01) |

(52) U.S. Cl.
CPC ..... *E04F 21/1652* (2013.01); *B25G 1/102* (2013.01); *B25G 3/26* (2013.01); *E04F 21/1655* (2013.01)

(58) Field of Classification Search
CPC ..... E04F 21/1657; E04F 21/163
USPC ..... 15/235
See application file for complete search history.

(56) References Cited

U.S. PATENT DOCUMENTS 5,467,497 A * 11/1995 Greene ..... E04F 21/1655 15/235.8
5,544,384 A * 8/1996 Forselius ..... E04F 21/163 15/235.8
5,664,280 A * 9/1997 Tonsager ..... E04F 21/1655 15/235.8
5,774,924 A * 7/1998 Beckham ..... E04F 21/161 15/235.8
5,792,489 A * 8/1998 Liberman ..... E04F 21/1655 425/458
7,725,982 B2 * 6/2010 Hoch ..... E04F 21/1655 15/235.8

FOREIGN PATENT DOCUMENTS

KR 200481098 Y * 8/2011
WO WO-2004033820 A1 * 4/2004 ..... E04F 21/163

* cited by examiner

*Primary Examiner* — Shay Karls
(74) *Attorney, Agent, or Firm* — Anthony Sgroi, Jr.

(57) ABSTRACT

A versatile compound tool for forming wall board compounds comprises a handle assembly having a handle along a first end and an extension along the second end. The extension along the second end of the handle assembly further includes a connection feature for selectively securing a first implement thereto, the first implement configured for performing a first function of forming wall board compounds. The versatile compound tool further comprises one or more subsequent implements selectively securable to the second end of the handle assembly for performing second and additional functions of forming wall board compounds.

18 Claims, 18 Drawing Sheets

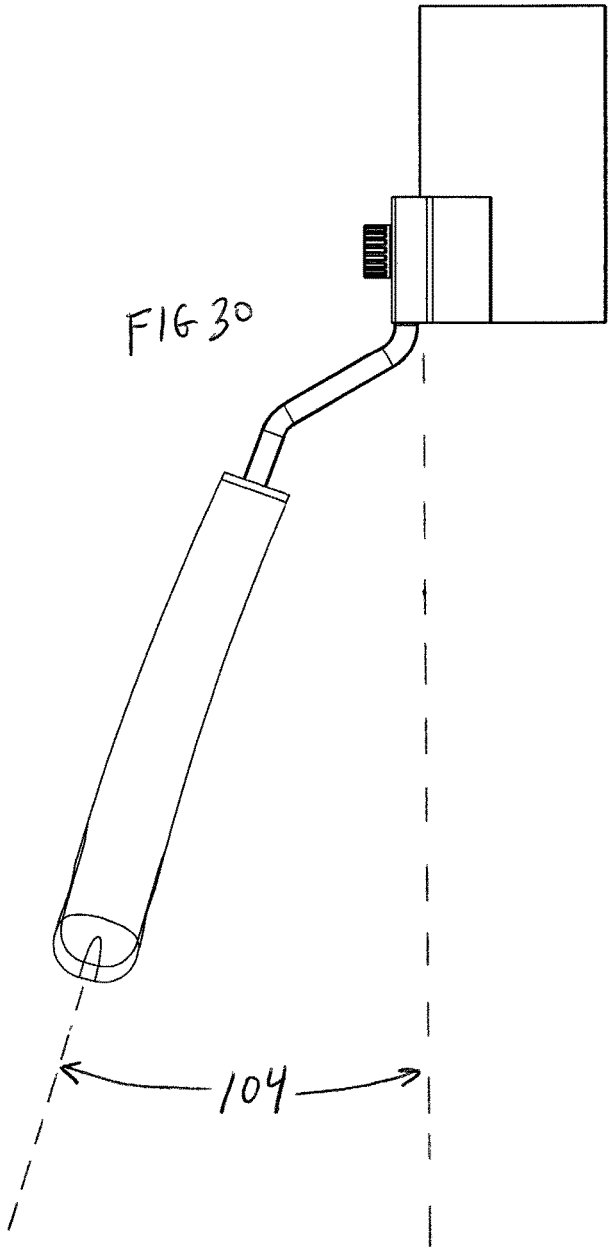
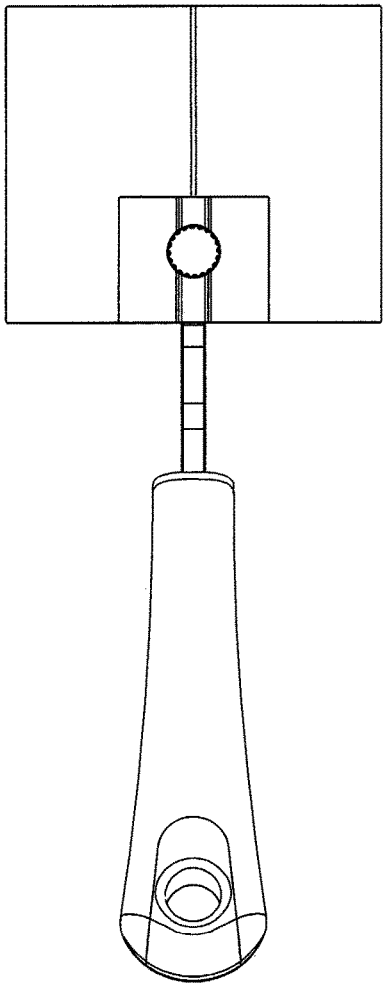
FIG 31

VERSATILE DRYWALL COMPOUND TOOL

CROSS REFERENCE TO RELATED APPLICATION

This application claims benefit to U.S. Provisional Application Ser. No. 63/041,131, filed Jun. 19, 2020, the contents of which are incorporated by reference herein.

BACKGROUND OF THE INVENTION

Field of the Invention

The present disclosure is related to drywall compound tools. More particularly, the present disclosure is related to drywall compound tools having interchangeable tool portions.

2. DESCRIPTION OF RELATED ART

The finishing tasks of drywall applications in buildings require a variety of tools and implements. During the construction process of internal walls, panels of drywall are affixed to support members such as wood or metal studs. If necessary, drywall panels may be cut to fit as needed for a certain wall configuration. Typically, drywall panels are affixed to the support members using screws or nails. After drywall panels have been affixed to the support members, the screw/nail depressions and the gaps between abutting drywall panels must be sealed to provide a surface suitable for finishing techniques such as painting, wallpaper, and the like. The finishing process involves the steps of filling screw and nail depressions with drywall compounds. Such applications can utilize a putty knife, wall board knife, taping knife, and the like. Once the wall compounds dry, the elevated areas are removed by one or more processes to level the wall compound to the wall. Such processes include and are not limited to sanding, wet sponging, etc.

The mating surfaces or joints of the drywall panels also require finishing techniques. In these areas, the combined use of wall compound and paper strips are used in combination. This process is commonly called taping. In this process, the wall compound is forced into the wall board seams using the aforementioned putty knife, wall board knife, and/or taping knife. While wet, a layer of paper strip is place along the wet portion of the wall compound covering the seams of the drywall panels. Once dried, another layer of wall board compound is added along the seam. The process is continued until the wall compound is at or above the drywall panel surface. Once the wall compounds dry, the elevated areas are removed by one or more processes to level the compound to the wall. Such processes include and are not limited to sanding, wet sponging, and the like.

In many areas, the application involves leveling the flat areas of the wall. In other areas, there exist internal and external corners. These are finished in the same manner using wall board compound and paper stripping. The mating surfaces of the inside and outside corners have a similar finishing technique. In these areas, the combined use of wall compound and paper strips are also used in combination with the added step of folding the paper strip in half along its length. Similar to the flat wall portions, the wall compound is applied along the internal and/or external wall board seams using the aforementioned putty knife, wall board knife, and/or taping knife. While wet, a layer of folded paper strip is place along the wet portion of the wall compound. The folding line being aligned to the seam of the external and internal corners of the drywall panels. Once dried, another layer of wall board compound is added along the seams. The process is again repeated until sufficient wall compound is applied. Once the wall compound dries, the elevated areas are removed by one or more processes to level the compound to the wall. Such processes include and are not limited to sanding, wet sponging, and the like.

Those having skill in the art can recognize that dealing with external and internal corners require specialized tools.

Therefore, there is a need for drywall compound tools that overcome, alleviate, and/or mitigate one or more of the aforementioned and other deleterious effects of prior art drywall compound tools.

BRIEF SUMMARY OF THE INVENTION

The process of dealing with external and internal corners require specialized tools for the application of drywall compound. Some users prefer to use an internal corner tool for applying wall compound in a single pass. In such an application, wall compound is applied along both sides of the internal corner. Once applied and while the compound is still workable, the internal corner tool is used along the internal corner in one or more strokes creating a smooth application of wall board compound along the internal corner. Such tools allow for a single application for the internal corner rather than multiple applications using a conventional flat putty knife.

With respect to an external corner, similar to working with internal corners, some users prefer to use an external corner tool for applying wall compound to the external corner in a single pass. In such an application, wall compound is applied along both sides of the external corner. Once applied and while the compound is still workable, the external corner tool is used along the external corner in one or more strokes creating a smooth application of wall board compound along the external corner. Such tools allow for a single application for the external corner rather than multiple applications using a conventional flat putty knife.

As those skilled in the art can appreciate, the process of working on internal and external corners requires multiple tools which may require the taper or drywaller to carry numerous tools. This also forces the drywaller the burden of dealing with the task of switching between the needed different tool styles. Thus, it would be beneficial for a single tool that can be use on both external and internal corners.

Wall board tools are provided that include multiple ends configured to apply wall compounds to external and internal corners of walls.

In one example, a versatile compound tool comprises a handle assembly having a first end and a second end. The handle assembly includes a handle along the first end and an extension extending from the handle along the second end including a first connection feature. The versatile compound tool includes a first implement having a first end and a second end. The first implement comprises a second connection feature along the first end and is configured for a first function along the second end. The versatile compound tool further comprises a retainer.

The first implement is removably securable to the handle assembly by the retainer when the first connection feature is engaged to the second connection feature so that the first implement is selectively removable for assembly of a second implement.

The second implement comprises a first end and a second end and is configured for a second function along the second end. The second implement includes a second connection feature along the first end.

In one example, the first connection feature is a threaded hole and the retainer comprises a threaded shaft engageable to the threaded hole for securing the first or second implement to the handle assembly.

In one example, the first implement is configured for forming compound in an internal corner and the second implement is configured for forming compound on an external corner.

The extension extending from the handle assembly comprises an offset which facilitates clearance from the wall to the handle to allow a user to grasp the handle in an ergonomic manner. The offset comprises a first portion, a second portion, and a third portion. The second portion is located at an angle from first portion and the third portion is located at an angle from second portion.

In one example, the extension forming the first connection feature extending from the handle comprises a square cross section and is engageable to a complimentary opening along the first or second implement. The complimentary opening comprises a clearance hole transverse the complimentary opening such that the threaded hole and the threaded shaft can be aligned for securing the first or second implement to the handle assembly by the retainer.

In one example, the handle assembly is fabricated in stainless steel, plated carbon steel, aluminum, plastic, metal, rubber, and any combinations thereof.

The first and second implements are fabricated in stainless steel, plated carbon steel, aluminum, plastic, metal, and any combinations thereof.

The above-described and other features and advantages of the present disclosure will be appreciated and understood by those skilled in the art from the following detailed description, and drawings.

BRIEF DESCRIPTION OF THE SEVERAL VIEWS OF THE DRAWINGS

FIGS. 28 through 34 are various projection views of the versatile drywall compound tool of FIG. 6.

DETAILED DESCRIPTION OF THE INVENTION

Figure 1:
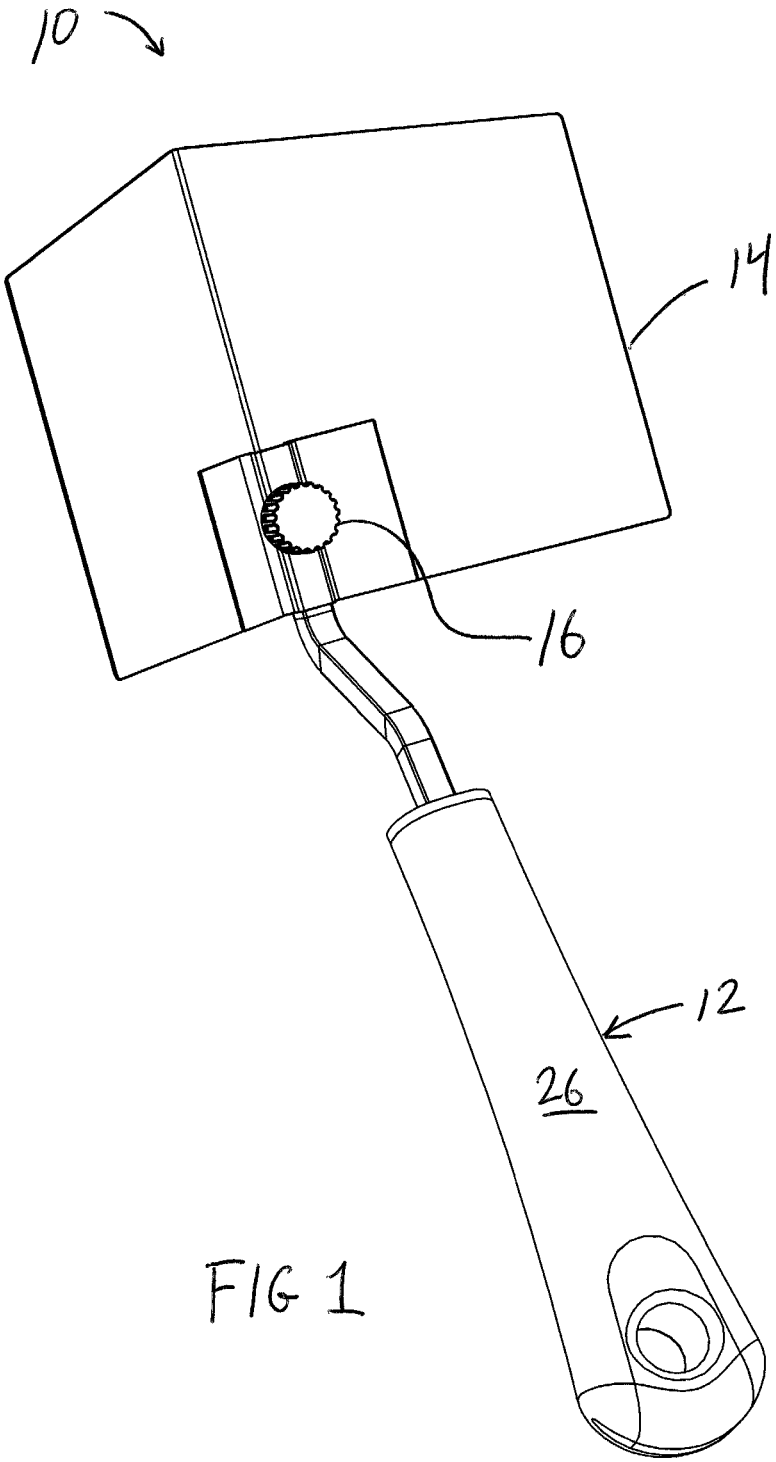
FIG. 1 is a perspective view of a first exemplary embodiment of a versatile drywall compound tool configured for use in an internal corner according to the present disclosure.
Figure 2:
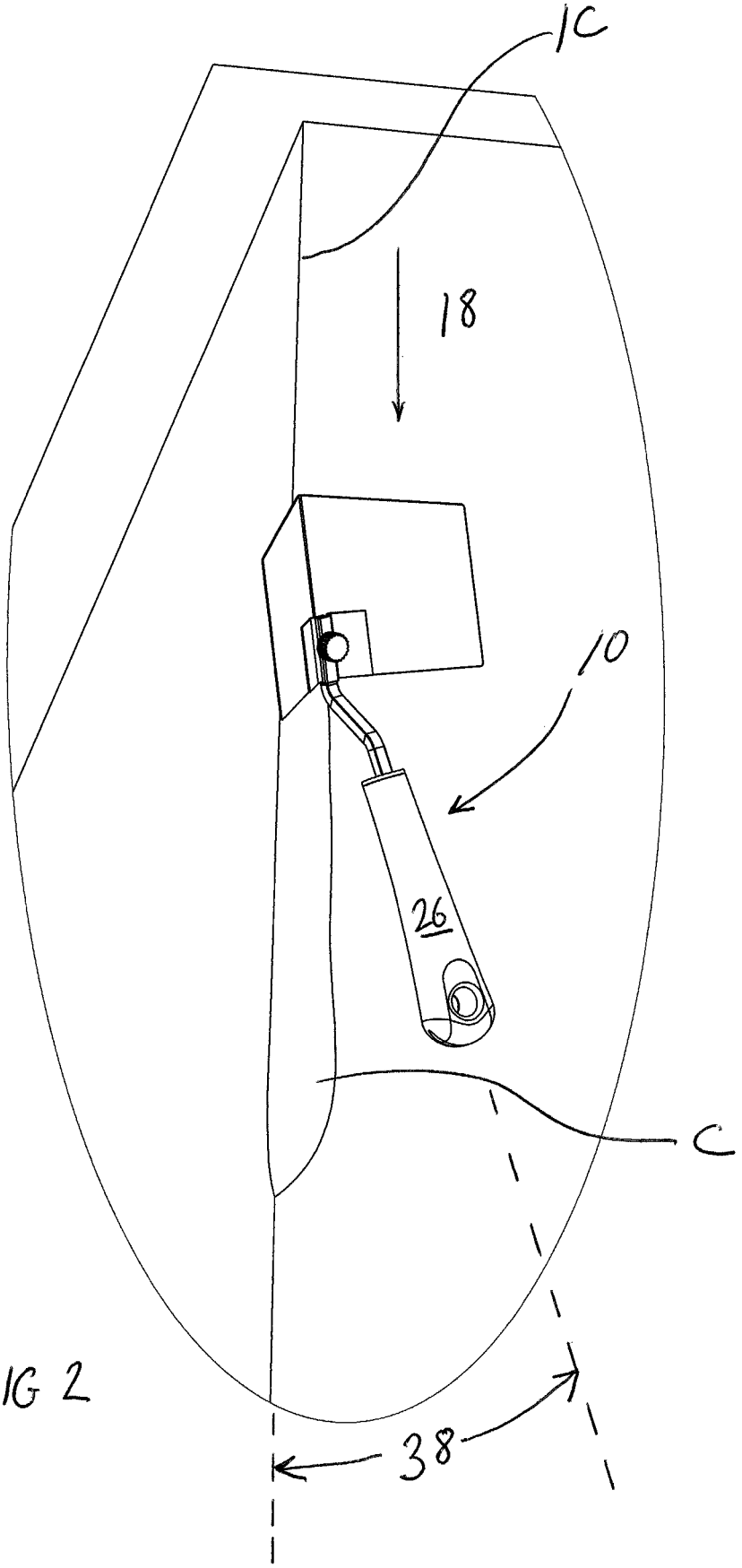
FIG. 2 is the versatile drywall compound tool of FIG. 1 in use in an internal corner.
Figure 3:
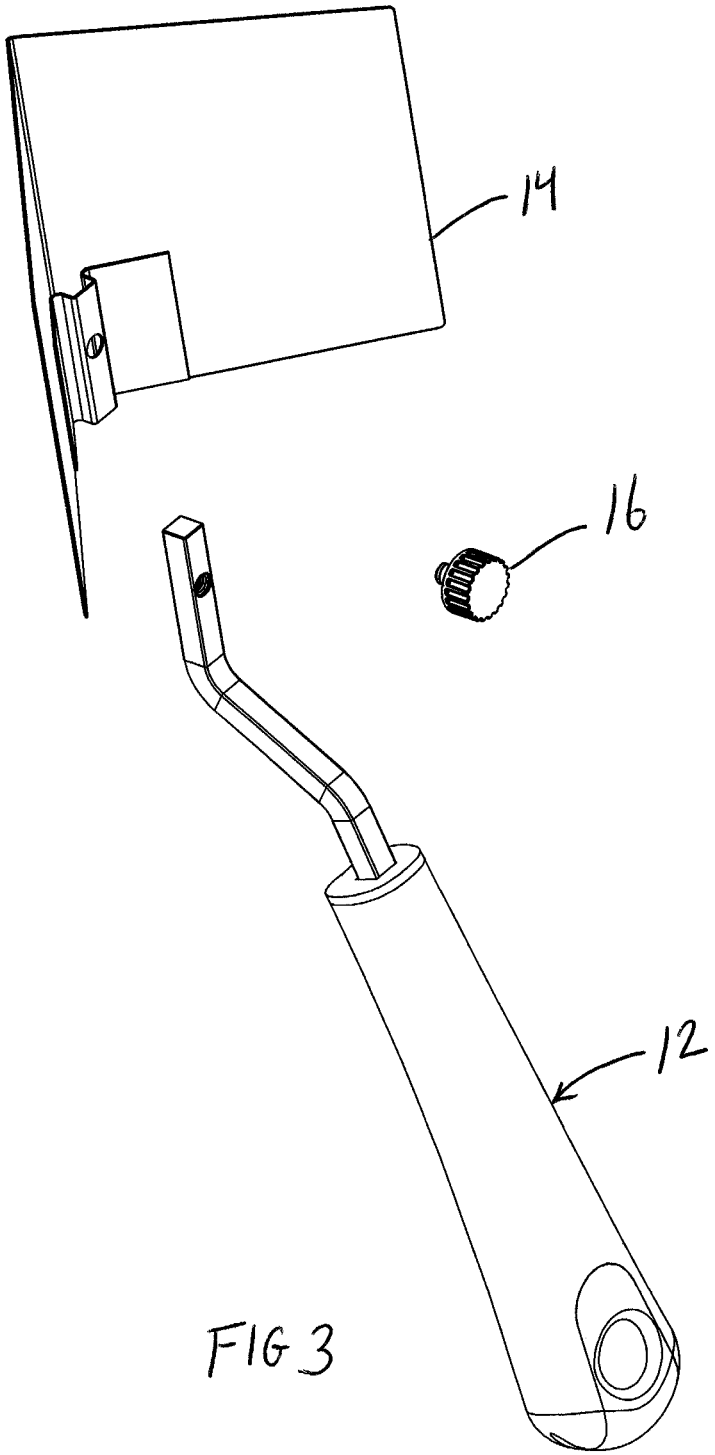
FIG. 3 is a perspective exploded view of the versatile drywall compound tool of FIG. 1.
Figure 4:
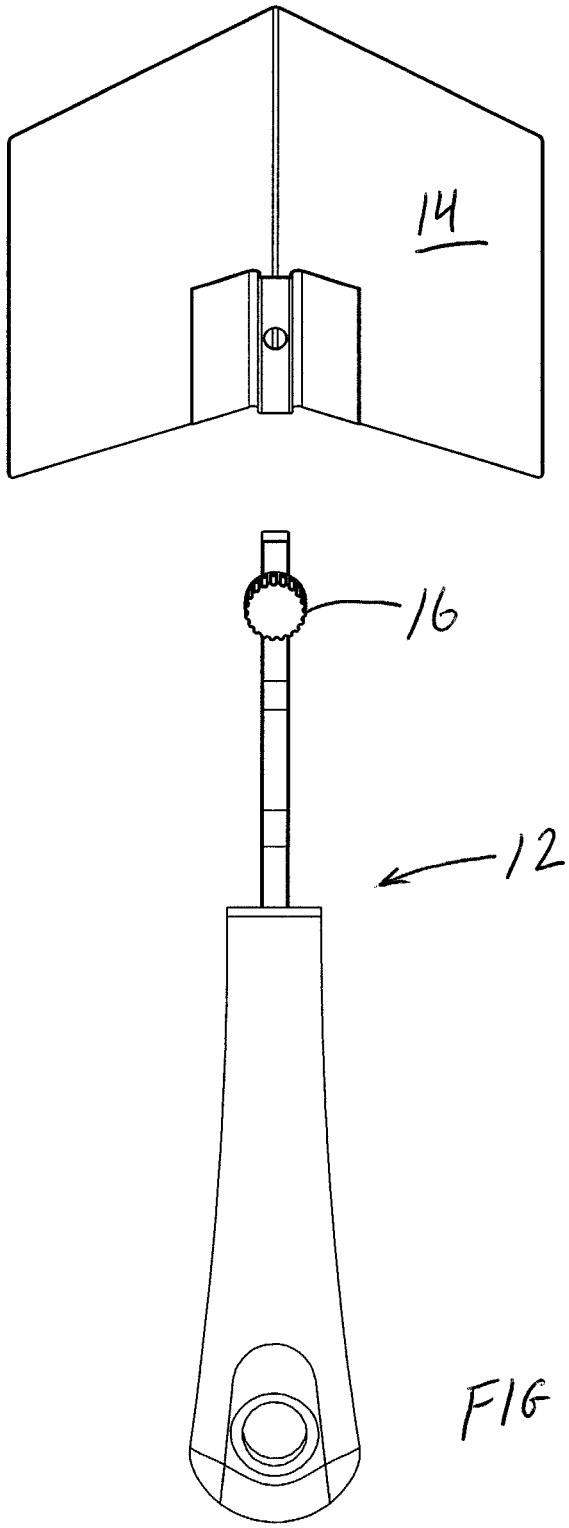
FIG. 4 is a front exploded view of the versatile drywall compound tool of FIG. 1.

Referring to the drawings and in particular to FIGS. 1 and 2, a versatile drywall compound tool according to an exemplary embodiment of the present disclosure is shown having reference numeral 10. Versatile drywall compound tool 10 (hereafter tool 10) includes a handle assembly 12, an internal implement 14, and a retainer 16.

Advantageously, internal implement 14 is removably secured to handle assembly 12 utilizing retainer 16. In this configuration, tool 10 finds use with the leveling, forming, and/or smoothing of compound C along internal corner IC along direction 18 (FIG. 2) by a drywall technician (hereafter taper). As seen in FIG. 2, compound C is applied into the internal corner IC and the adjacent surfaces of the walls defining internal corner IC. In this manner, the excess compound C is smoothed using internal implement 14 along direction 18 (i.e. motion from top to bottom). It is also contemplated that tool 10 can be operated in the reverse manner opposite direction 18, namely bottom to top if desired.

Figure 5:
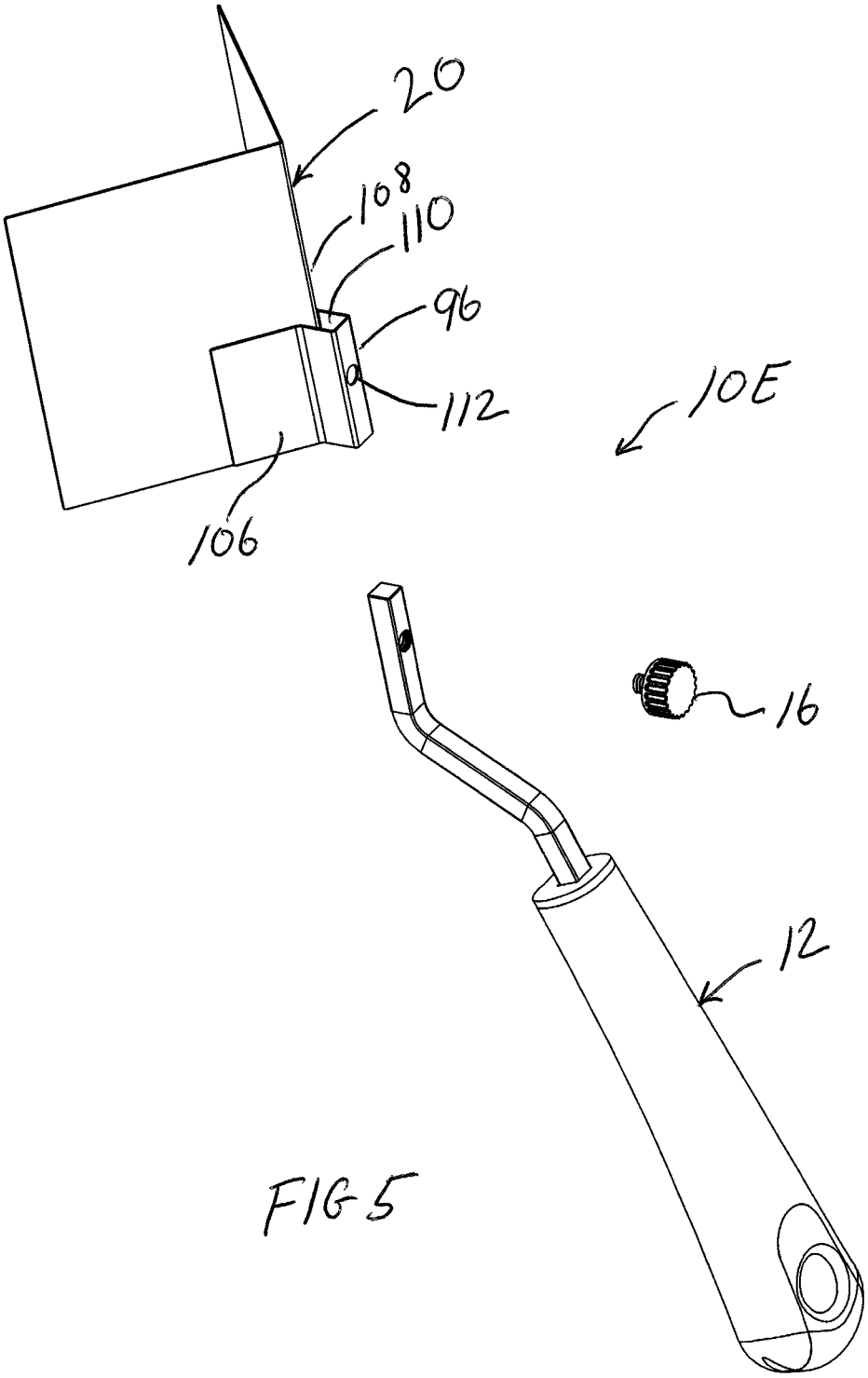
FIG. 5 is an exploded view of versatile drywall compound tool configured for use on an external corner.
Figure 6:
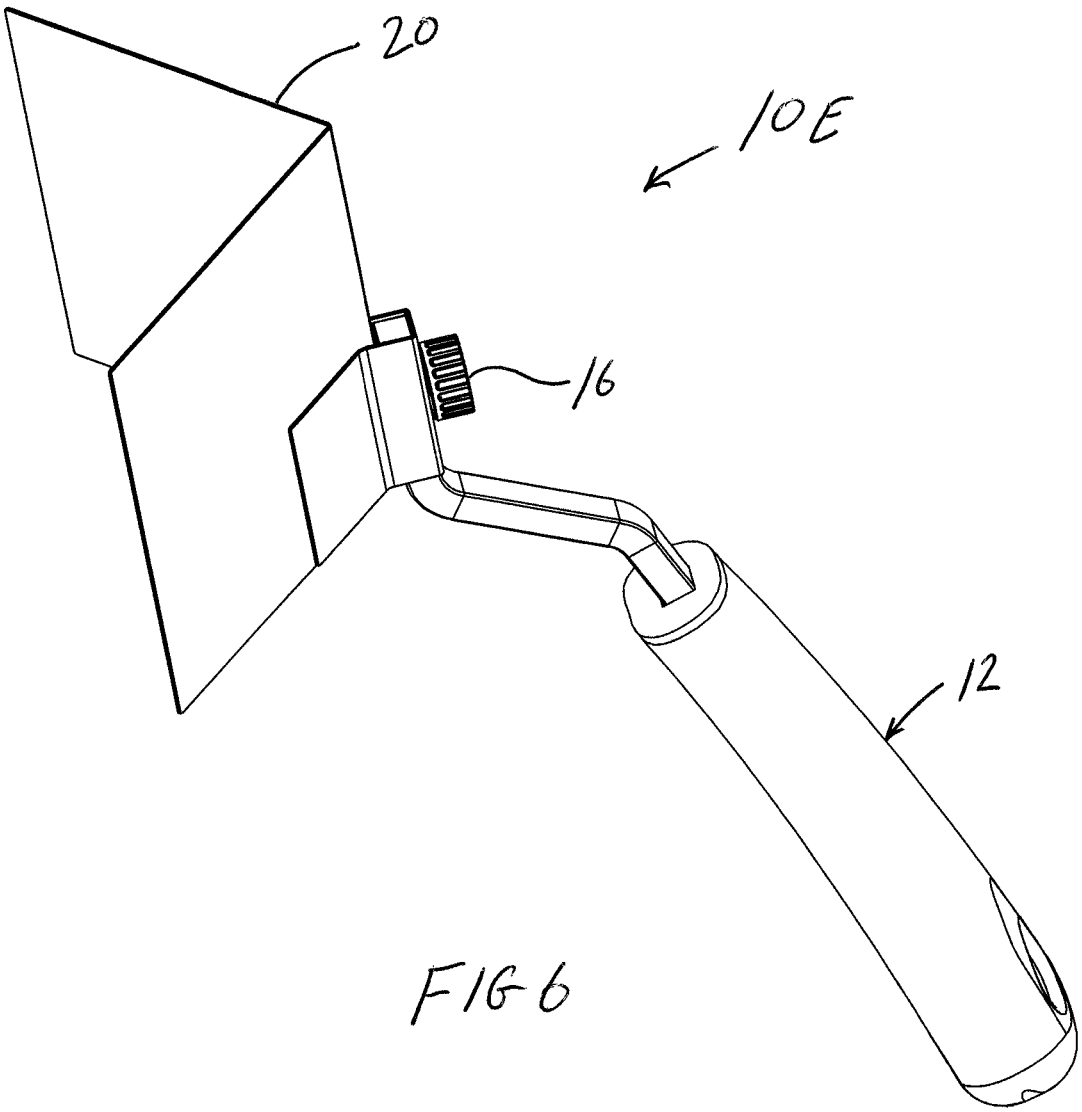
FIG. 6 is a perspective view of the versatile drywall compound tool of FIG. 5 shown in the assembled state.

In the event that a taper is required to work on an external corner, tool 10 can be configured to level, form, and/or smooth an external corner. By reference to FIG. 5, internal implement 14 is now replaced by external implement 20. In this dissembled state, external implement 20 is ready for assembly onto to handle assembly 12. Once assembled, retainer 16 maintains the assembly of tool 10E now configured for use on external corners. The assembled version of 10E configured for use on external corners is illustrated in FIG. 6.

Figure 7:
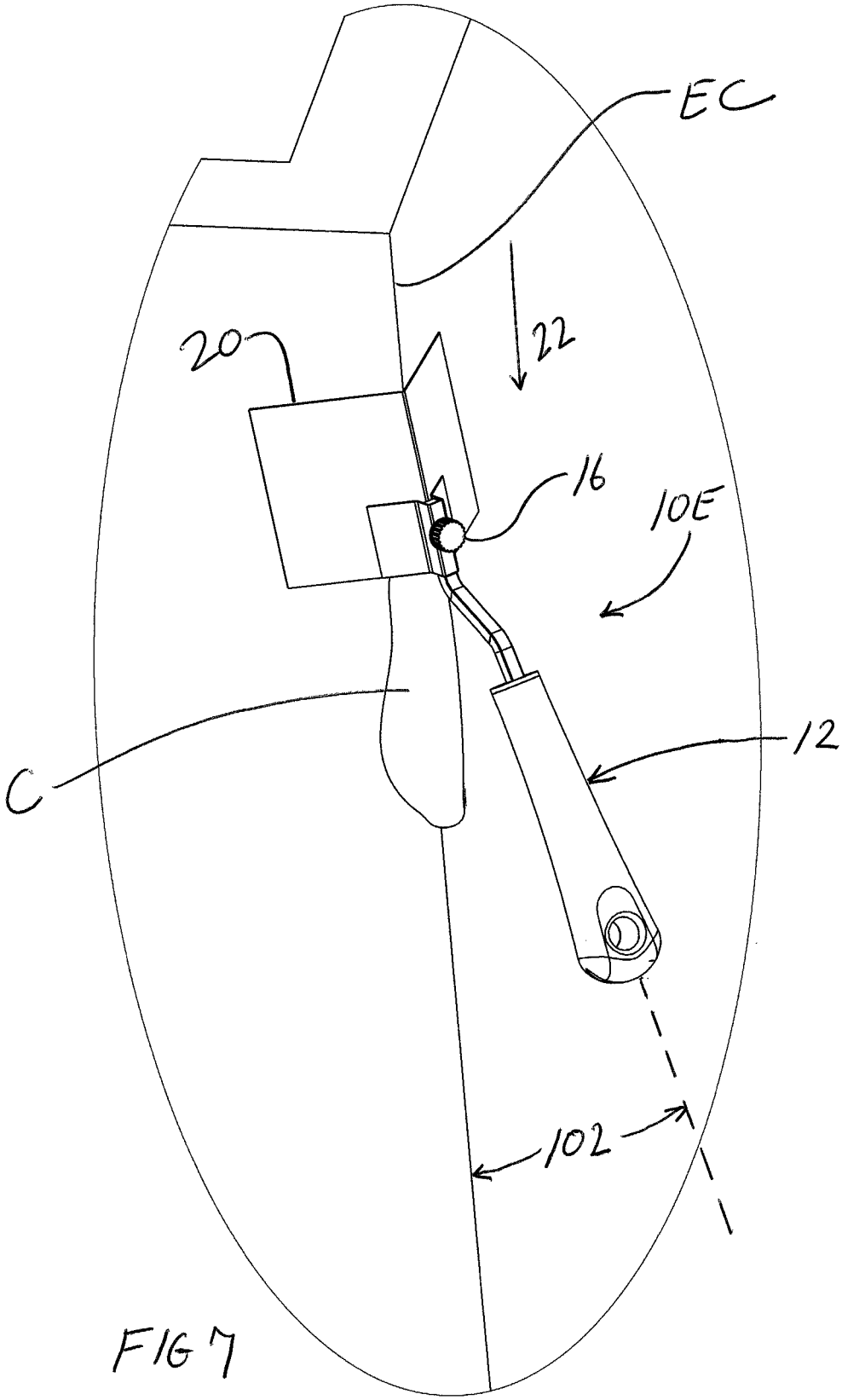
FIG. 7 illustrates the versatile drywall compound tool of FIG. 6 in use on an external corner.
Figure 8:
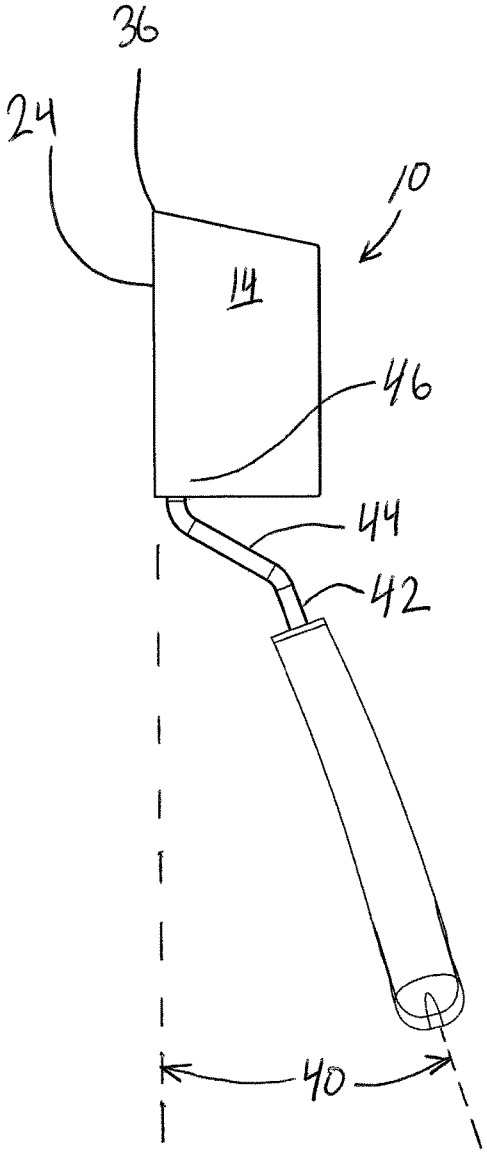
FIGS. 8 through 15 are various projection views of the versatile drywall compound tool of FIG. 1.

Turning now to FIG. 7, tool 10E is shown in use leveling, forming, and/or smoothing compound C along an external corner EC. In this configuration, tool 10E finds use with the leveling, forming, and/or smoothing of compound C along external corner EC along direction 22. As seen in the illustration, compound C is applied onto the external corner EC and the adjacent surfaces of the walls defining external corner EC. In this manner, the excess compound C is smoothed using external implement 20 along direction 22 (i.e. motion from top to bottom). It is also contemplated that tool 10E can be operated in the reverse manner opposite direction 22, namely bottom to top if desired.

In the present embodiment, the term drywall technician or taper can include a working professional or can include a periodic user or non-professional such as a homeowner performing home repairs or improvements.

Figure 9:
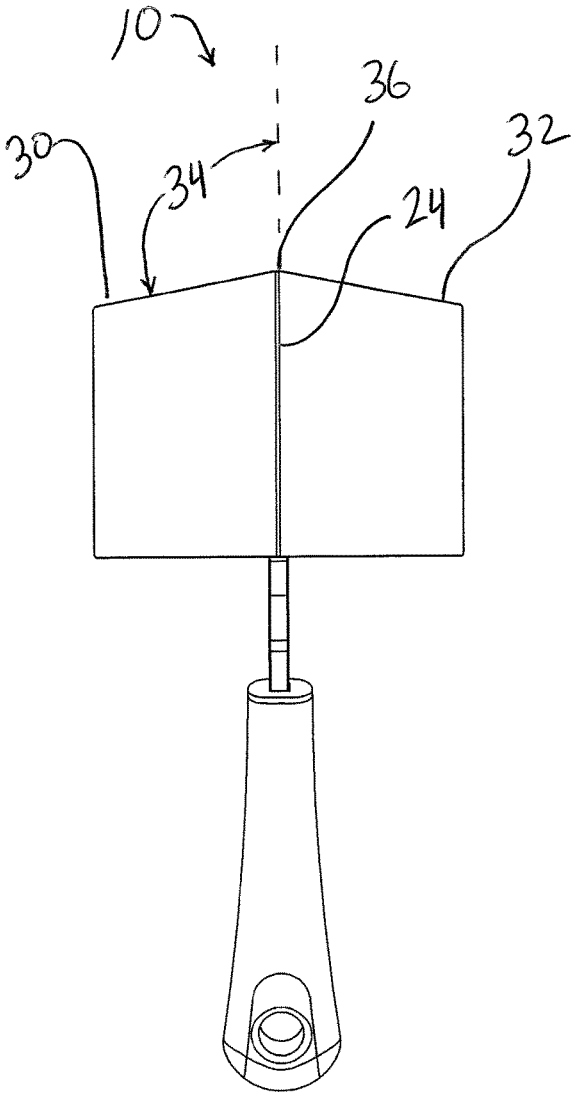
Figure 10:
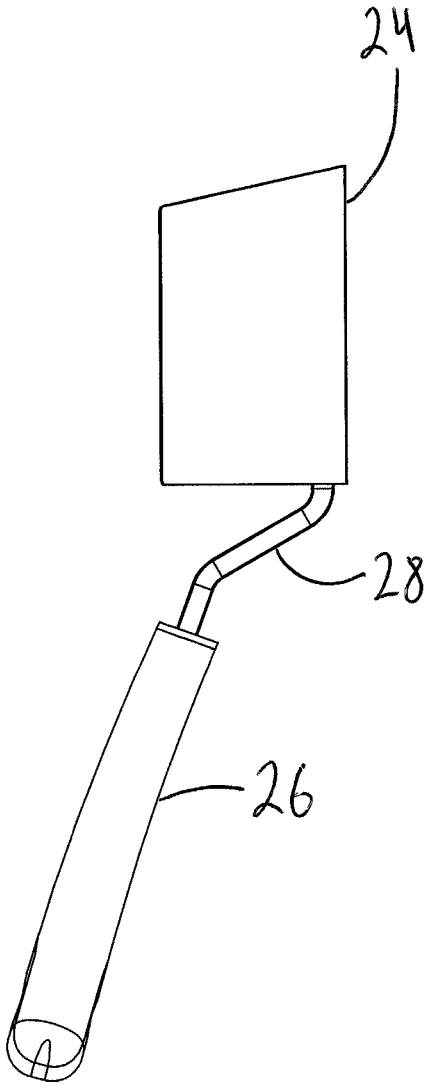
Figure 11:
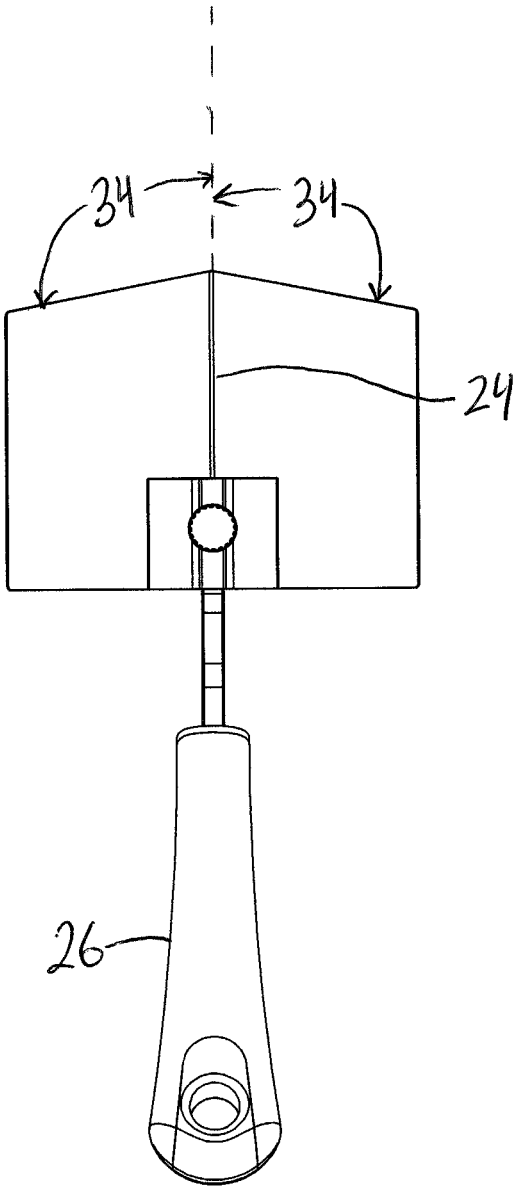

Details of tool 10 will now be described with reference to the version of tool 10 configured for use on internal corners. By simultaneous reference to FIGS. 8 through 14, various aspects of tool 10 is described. Along a first direction, more specifically as detailed in FIGS. 9 and 11, internal implement 14 of tool 10 includes a first edge 30, a second edge 32 terminating into a contact edge 24. First and second edges 30/32 are substantially symmetrical about contact edge 24.

Figure 12:
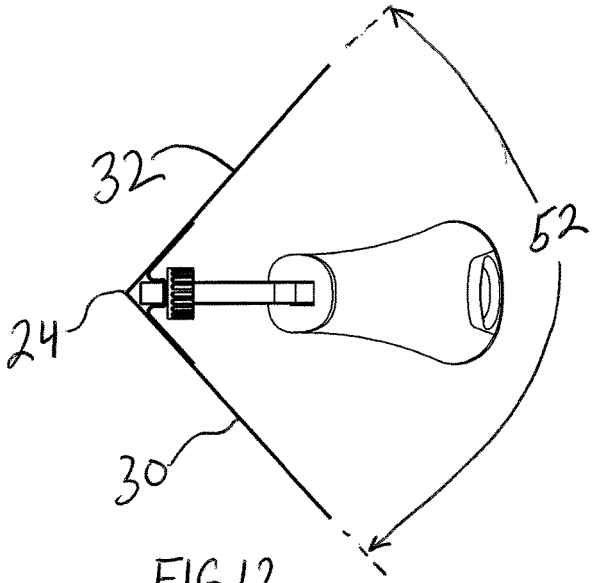
Figure 13:
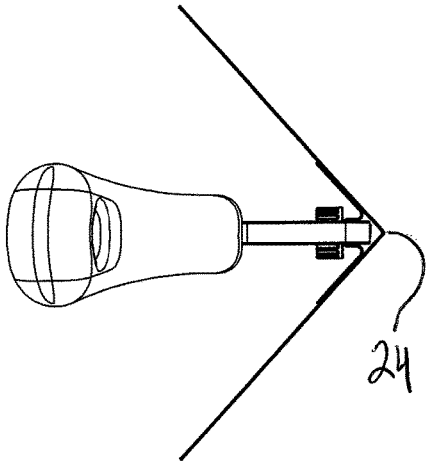
Figure 14:
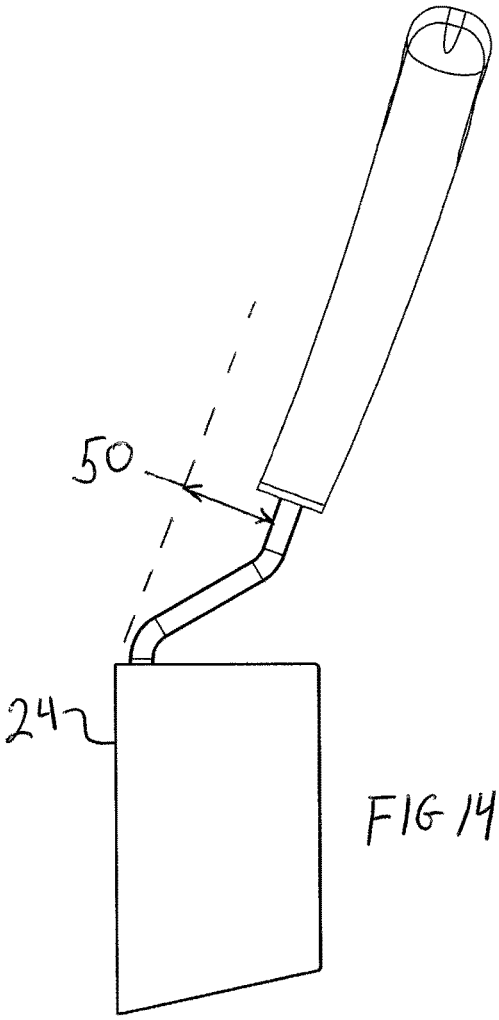
Figure 15:
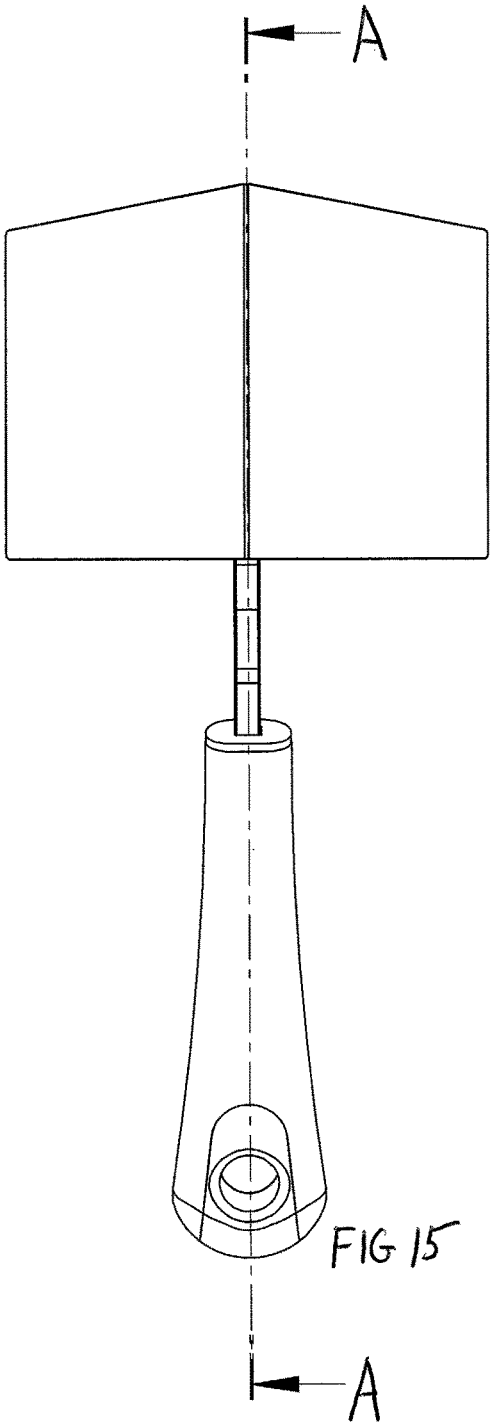

Along a second direction, more specifically as detailed in FIGS. 12 and 13, internal implement 14 of tool 10 includes an angle 52 defining symmetrical first edge 30 and second edge 32. Angle 52 is central to contact edge 24. In the illustrated embodiment, angle 52 is about 96 degrees. Those skilled in the art can appreciate that angle 52 can find use in a range of alternate values. In one embodiment, angle 52 is 91 degrees to about 101 degrees where 94 degrees to about 98 degrees is a common range. Of course, other angular values are contemplated.

Turning back to FIGS. 8, 9, and 11, first and second edges 30/32 further include a respective back angle 34. The pair of back angles 34 allows tip 36 access into the internal corner IC. Back angles 34 are configured to allow tool 10 to rotate away from internal corner IC at an angle 38 (FIG. 2). Angle 38 is the result of first and second contact edges 30/32 in simultaneous contact to the walls in combination to tip 36 being engaged to internal corner IC. Angle 38 facilitates the necessary clearance from the wall to allow the taper to grasp handle 26 in an ergonomic manner.

Figure 16:
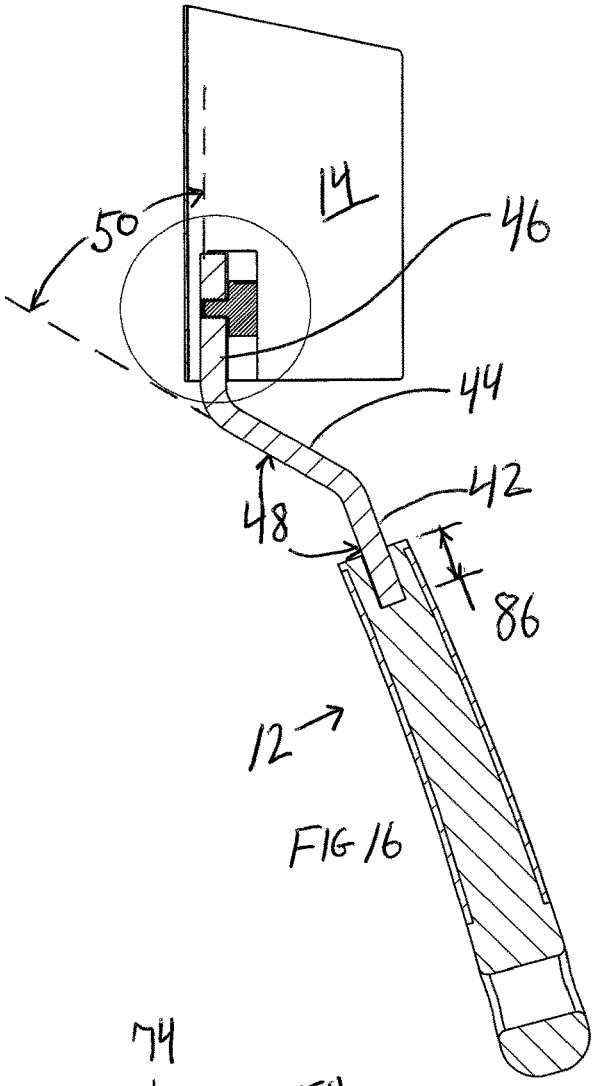
FIG. 16 is a cross-sectional view taken from line A-A from FIG. 15.
Figure 17:
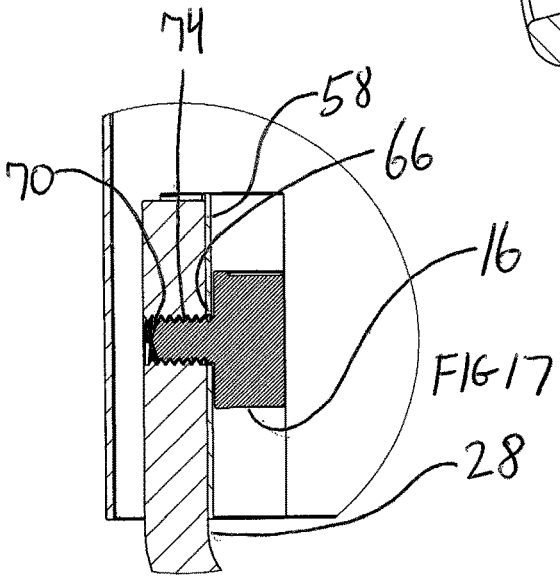
FIG. 17 is a detailed view taken from FIG. 16.
Figure 18:
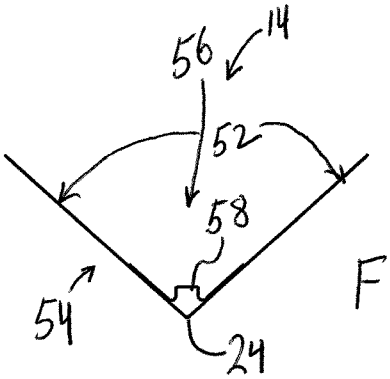
FIGS. 18 through 22 are various views of the implement configured for use in an internal corner of the versatile drywall compound tool of FIG. 1.
Figure 19:
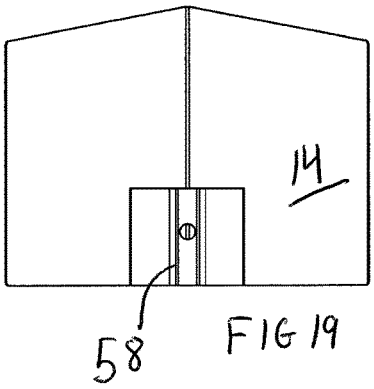
Figure 20:
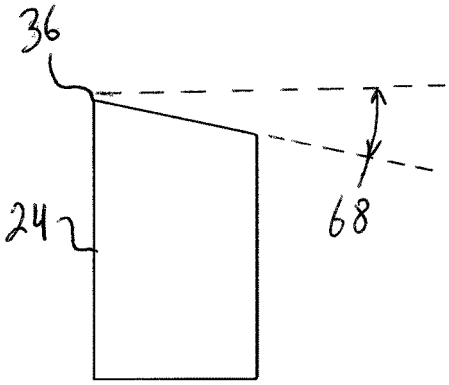
Figure 21:
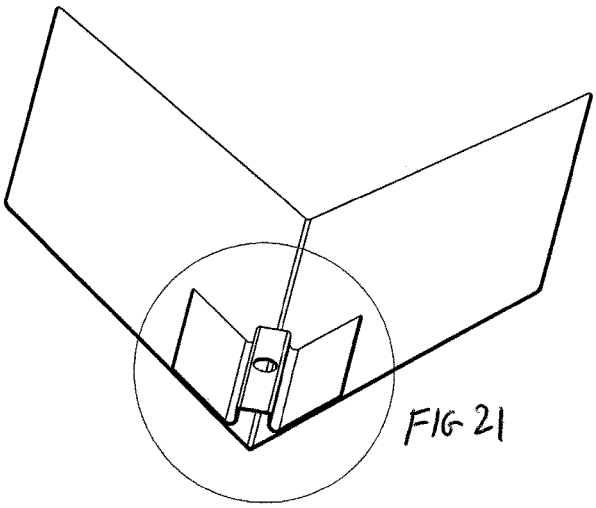
Figure 22:
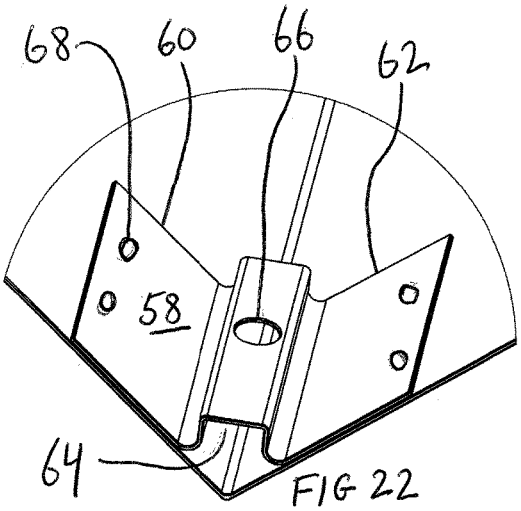

Additional grasping clearance in addition to the clearance derived from angle 38 is included as per the configuration of extension 28. With simultaneous reference to FIGS. 8, 14, and 16, extension 28 comprises a first portion 42, a second portion 44, and a third portion 46. Second portion 44 is located at angle 48 from first portion 42. Third portion 46 is located at angle 50 from second portion 44. These combinations result in angle 40 from handle 26 to contact edge 24 which also forms an offset 50.

The aforementioned angle 38, angle 40, and offset 50 work in combination and allows the taper to utilize an ergonomic grip of tool 10 during use.

In the illustrated embodiment, the elements of internal implement 14 is fabricated in stainless steel sheet and formed using a stamping process. It is contemplated by this disclosure that other suitable materials can be used to fabricate the elements of internal implement 14 including and not limited to plated sheet metal, aluminum sheet, plastic sheets, among others. It is also contemplated that other suitable manufacturing methods can be used to fabricate the elements of internal implement 14 including and not limited to machining, molding, casting, and the like.

Addition details of internal implement 14 are now described by simultaneous reference to FIGS. 18 through 22. Internal implement 14 includes a first end 54 comprising the aforementioned contact edge 24 and a second end 56 which includes the aforementioned angle 52. Contained within the second end 56 is a housing 58. Housing 58 includes a first fold 60 and a second fold 62. First and second folds 60/62 are symmetrical along the center of housing 58 and compliment angle 52 to allow for housing 58 to mate along the second end 56 of internal implement 14. Housing 58 is attached along the second end 56 using a plurality of spot welds 68. The forming of first and second folds 60/62 form the opening 64 along the central portion of housing 58. Opening 64 is complementary is shape to that of extension 28 to allow for extension 28 to pass through opening 64. Along the length of opening 64 is a hole 66.

It should be noted that instead of utilizing a plurality of spot welds 68 to attach housing 58 to form opening 64, opening 64 can be formed integral to internal implement 14 (a single component) such as a single molded component or a single machined component with opening 64 included thereto. Internal implement 14 further includes an angle 68 when orientated along the side. Angle 68 is a result of the interactions of aforementioned angle 58 and back angles 34 detailed above.

The details of securing internal implement 14 to handle assembly 12 are now described with simultaneous reference to FIGS. 15 through 23 and FIGS. 25 through 27. With respect to FIG. 16, tool 10 illustrates internal implement 14 and handle assembly 12 in cross section and in the assembled state. In the assembled state, extension 28 of handle assembly 12 is inserted into opening 64 formed along the assembly of housing 58. Once extension 28 is inserted into opening 64, the threaded hole 70 (FIG. 23) is aligned to hole 66 of housing 58. Hole 66 allows for retainer 16, more specifically threaded shaft 74 of retainer 16 to pass therethrough and engage threaded hole 70 (FIG. 17) of extension 28. Once threaded shaft 74 is engaged to threaded hole 70, retainer 16 can be secured by grasping and rotating body 72 of retainer 16 and forming a tight threaded connection. When it is desired to remove internal implement 14 from handle assembly 12, the steps are repeated in the reverse. More specifically, the threaded connection of threaded shaft 74 of retainer 16 to threaded hole 70 of extension 28 is removed so that retainer 16 can be removed. This allows for internal implement 14 to be removed from handle assembly 12.

Figure 24:
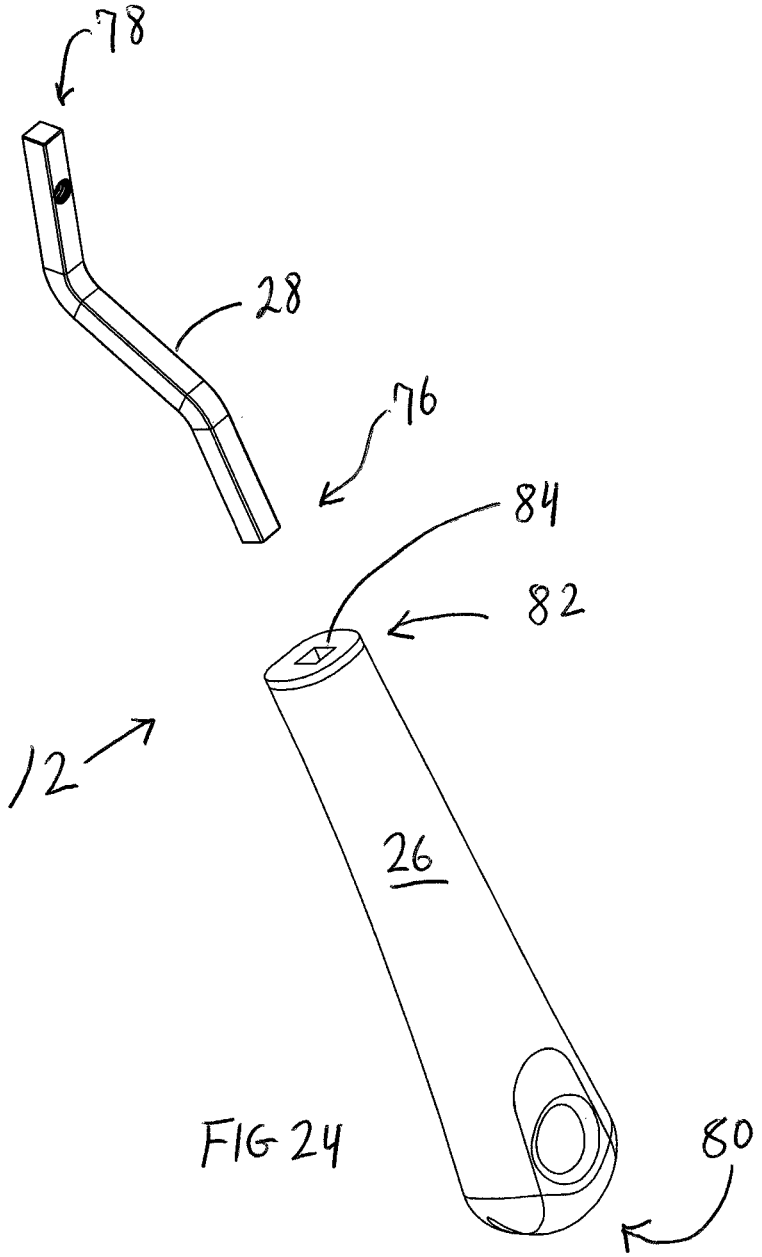
FIG. 24 is an exploded perspective view of the handle assembly of FIG. 23.

Turning to FIG. 24, handle 26 comprises a proximal end 80 and a distal end 82. Along distal end 82 is pocket 84. Pocket 84 is shaped complimentary to the cross section of extension 28. In this embodiment, pocket 84 is square in shape. However, it is contemplated that pocket 84 and the complimentary cross section of extension 28 can be formed in other suitable shapes including and not limited to rectangular cross sections, triangular cross sections, oval cross sections, and the like. In the illustrated embodiment, handle 26 is fabricated in molded plastic using an injection molding process. In other embodiments, handle 26 can include an over-molded rubber grip formed using thermoplastic rubber. It is contemplated by this disclosure that other suitable materials can be used to fabricate handle 26 including and not limited to wood, aluminum, metal, among others. It is also contemplated that other suitable manufacturing methods can be used to fabricate the handle 26 including and not limited to machining, casting, and the like.

Extension 28 comprises a proximal end 76 and a distal end 78. Proximal end 76 is assembled to handle 26. Distal end 78 of extension 28 includes the aforementioned threaded hole 70. Extension 28 further comprises the aforementioned first portion 42, second portion 44, third portion 46, angle 48, and angle 50 detailed above.

In the illustrated embodiment, extension 28 is fabricated using stainless steel wire having a square cross section and formed using a plurality of bending operations to form angle 48 and angle 50. It is contemplated by this disclosure that other suitable materials can be used to fabricate extension 28 including and not limited to plated carbon steel, aluminum, thermoplastic, among others. It is also contemplated that other suitable manufacturing methods can be used to fabricate extension 28 including and not limited to machining, molding, stamping, casting, and the like.

Figure 23:
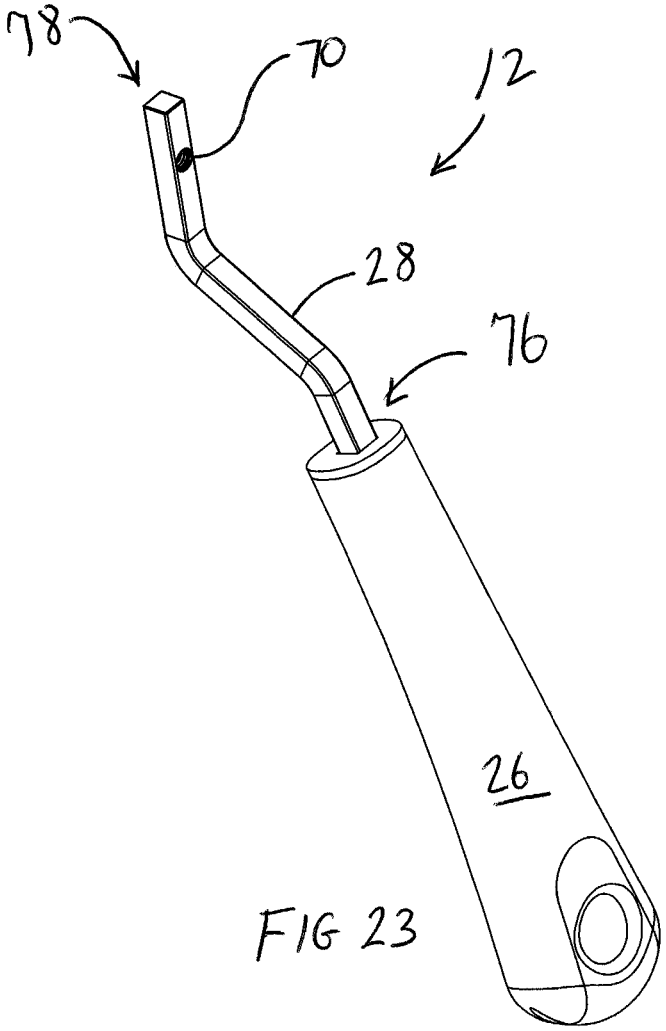
FIG. 23 is a perspective view of a handle assembly of the versatile drywall compound tool.

Handle assembly 12 is now described with simultaneous reference to FIGS. 23 and 24. As seen in FIG. 23, handle assembly comprises the assembly of extension 28 to handle 26 ready-for-use. Turning now to FIG. 24, handle assembly 12 is shown in exploded view illustrating the individual components of handle assembly 12 prior to assembly. As seen in FIG. 24, handle 26 comprises the aforementioned pocket 84, pocket 84 is smaller in dimension as compared to the cross section of extension 28 and forms an interference-fit connection. During assembly of handle assembly 12, proximal end 76 of extension 28 is forced (i.e. pressed) into pocket 84 to a depth 86 (FIG. 16) forming a permanent connection. In the illustrated embodiment, the cross section of extension 28 and the shape of pocket 84 is square. However, it is contemplated that extension 28 and the shape of pocket 84 can have alternate compliment shapes such as and not limited to circular, triangular, elliptical, oval, rectangular, etc. It should be noted that handle 26 can be formed in materials that expand during heating to allow for pocket 84 to enlarge for assembly. During expansion of pocket 84, the proximal end 76 of extension 28 is easily pressed into pocket 84 using minimal effort. Once cooled, pocket 84 of handle 26 would shrink back to its original size forming an enhanced permanent connection. In one aspect of this production assembly process, a plurality of handles 26 are stored in a hot water bath (i.e. 200 degrees Fahrenheit) in the production line. The assembly technician, utilizing waterproof temperature resistant gloves, would select a handle 26 with pocket 84 in the expanded (larger) state and quickly insert pocket 84 into proximal end 76 of extension 28. Such an arrangement would eliminate the need for specific tooling to fixture the components for production assembly and will also form an enhanced assembly condition. Those having skill in the art can recognize that the proximal end 76 of extension 28 can have a knurled end to further enhance the interference-fit connection.

Figure 25:
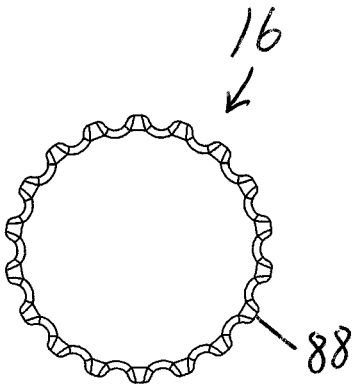
FIGS. 25 through 27 illustrate views of the retainer of the versatile drywall compound tool.
Figure 26:
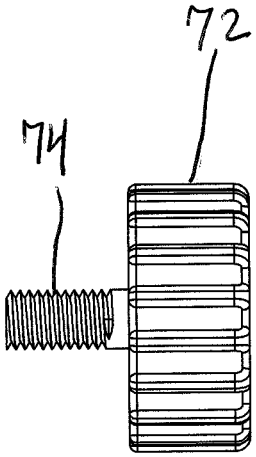
Figure 27:
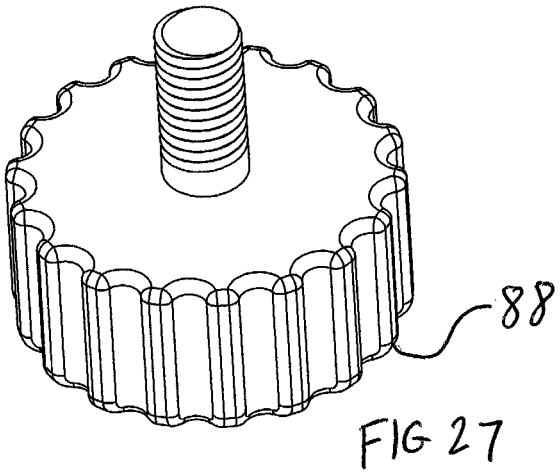

Retainer 16 is now detailed with simultaneous reference to FIGS. 25 through 27. Retainer 16 comprises a body 72 and a threaded shaft 74. Body 72 comprises a general cylindrical shape. In one embodiment, body 72 can comprise a plurality of bumps 88 to facilitate grasping by a user. In another embodiment, body 72 can include a knurled surface along the diameter. Threaded shaft 74 extends from body 72 and is concentric to body 72.

In one embodiment, threaded shaft 74 is integral to body 72 forming retainer 16 in a single component. Such a configuration is achieved by forming retainer 16 from stainless steel bar stock using a lathe turning process. The lathe would cut the general shape of retainer 16 forming body 72 and stepping down to form threaded shaft 74. Once completed, retainer 16 is removed from the bar stock and the next retainer 16 is formed. A CNC lathe can form a plurality of retainers 16 automatically. In one embodiment, the completion of the lathe process would create retainer 16 without the aforementioned bumps 88. In another embodiment, a secondary milling operation can be employed to create the plurality of bumps 88.

Other suitable materials for forming retainer 16 using a lathe process are also possible including and not limited to plastic, aluminum, metal, and the like. It is also contemplated that retainer 16 can be manufactured using alternate methods including and not limited to milling, metal injection molding (MIM), power metal, and the like.

Those having skill in the art can appreciate that shaft 74 and body 72 can be formed individually and then assembled to one another. In this example, body 72 can be manufactured using any chosen material and process such as thermoplastic injection molding. Other suitable materials and manufacturing methods are possible including and not limited to machining of steel or plastic, casting, and the like.

Threaded shaft 74 can also be formed using any chosen material and manufacturing method such as and not limited to steel formed on a lathe, steel formed using a screw machine, metal injection molding and sintering (MIM), and the like.

Threaded shaft 74 can then be assembled to body 72 in any known manner such as and not limited to interference fit connection, welded connection, heat-stake connection, and the like. It is also contemplated that body 72 can be over-molded onto threaded shaft 74.

In the event that a taper is required to work on an external corner, tool 10 can be adjusted for the purposes of working on external corners. In this manner, internal implement 14 can be removed from handle assembly 12. With reference to FIGS. 15 through 23, the description of the steps for removing internal implement is briefly repeated. The removal process begins with the removal retainer 16, more specifically, the removal of the threaded connection of threaded shaft 74 of retainer 16 to threaded hole 70 of extension 28. Once retainer 16 is removed, internal implement 14 can be removed from handle assembly 12. By reference to FIG. 5, internal implement 14 can now be replaced by a subsequent implement, namely external implement 20. In this dissembled state, external implement 20 is ready for assembly onto to handle assembly 12. Once assembled, retainer 16 maintains the assembly of tool 10E as described above. Tool 10E is now configured for use on external corners. The assembled version of 10E configured for use on external corners is illustrated in FIG. 6.

With simultaneous reference to FIG. 7, and FIGS. 28 through 34, tool 10E configured for use on external corners is now described. Along a first direction, more specifically as detailed in the illustrations, external implement 20 of tool 10E includes a subsequent first edge 90, a subsequent second edge 92 terminating into a subsequent contact edge 94. First and second subsequent edges 90/92 are substantially symmetrical about subsequent contact edge 94.

Along a second direction, more specifically, external implement 20 of tool 10E includes an angle 100 defining symmetrical subsequent first edge 90 and subsequent second edge 92. Angle 100 is central to subsequent contact edge 94. In the illustrated embodiment, angle 100 is about 90 degrees. Those skilled in the art can appreciate that angle 100 can find use in a range of alternate values. In one embodiment, angle 100 is 85 degrees to about 95 degrees where 88 degrees to about 92 degrees is a common range. Of course, other angular values are contemplated.

The configuration of tool 10E in use with external corners EC allows tool 10E to rotate away from external corner EC at an angle 102 (FIG. 7). Angle 102 is the result of first and second subsequent edges 90/92 in simultaneous contact to the walls when tool 10E is engaged to external corner EC. Angle 102 facilitates the necessary clearance from the wall to allow the taper to grasp handle 26 in an ergonomic manner.

Figure 28:
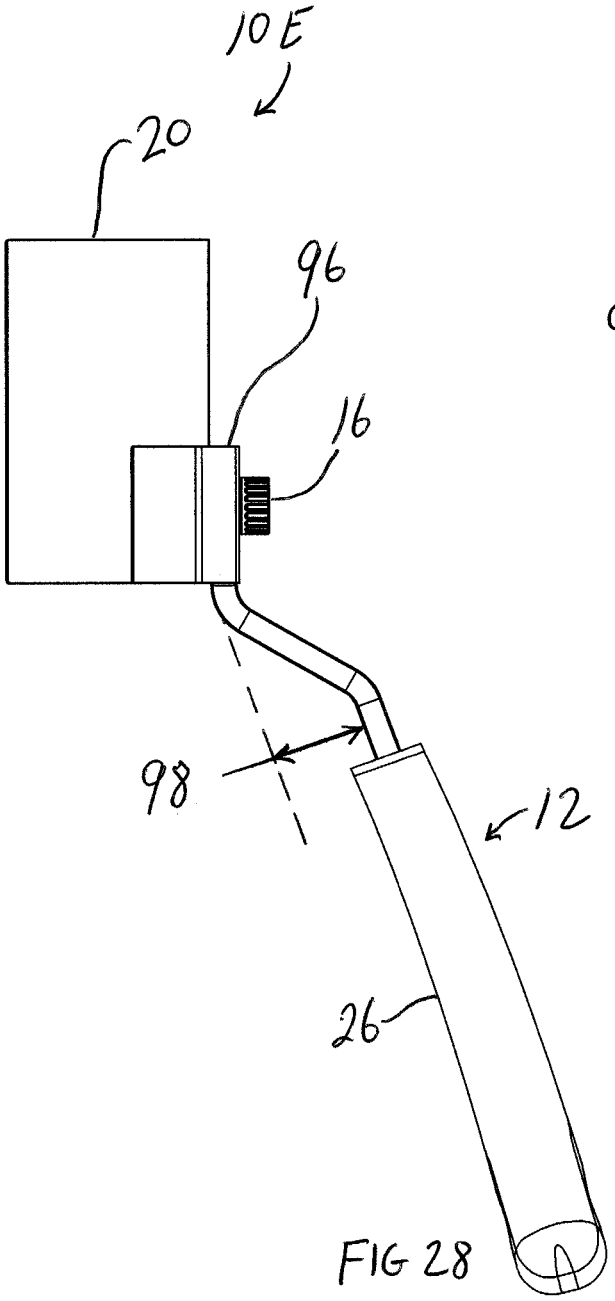

Additional grasping clearance in addition to the clearance derived from angle 102 is included as per the configuration of extension 28. As detailed above, and turning back to FIGS. 8, 14, and 16, extension 28 comprises a first portion 42, a second portion 44, and a third portion 46. Second portion 44 is located at angle 48 from first portion 42. Third portion 46 is located at angle 50 from second portion 44. These combinations result in angle 104 from handle 26 to contact edge 94 which also forms an offset 98 (FIG. 28).

The aforementioned angle 102, angle 104, and offset 98 works in combination and allows the taper to utilize an ergonomic grip of tool 10E during use.

In the illustrated embodiment, the elements of external implement 20 is fabricated in stainless steel sheet and formed using a stamping process. It is contemplated by this disclosure that other suitable materials can be used to fabricate the elements of external implement 20 including and not limited to plated sheet metal, aluminum sheet, and plastic sheets, among others. It is also contemplated that other suitable manufacturing methods can be used to fabricate the elements of external implement 20 including and not limited to machining, molding, casting, and the like.

Figure 29:
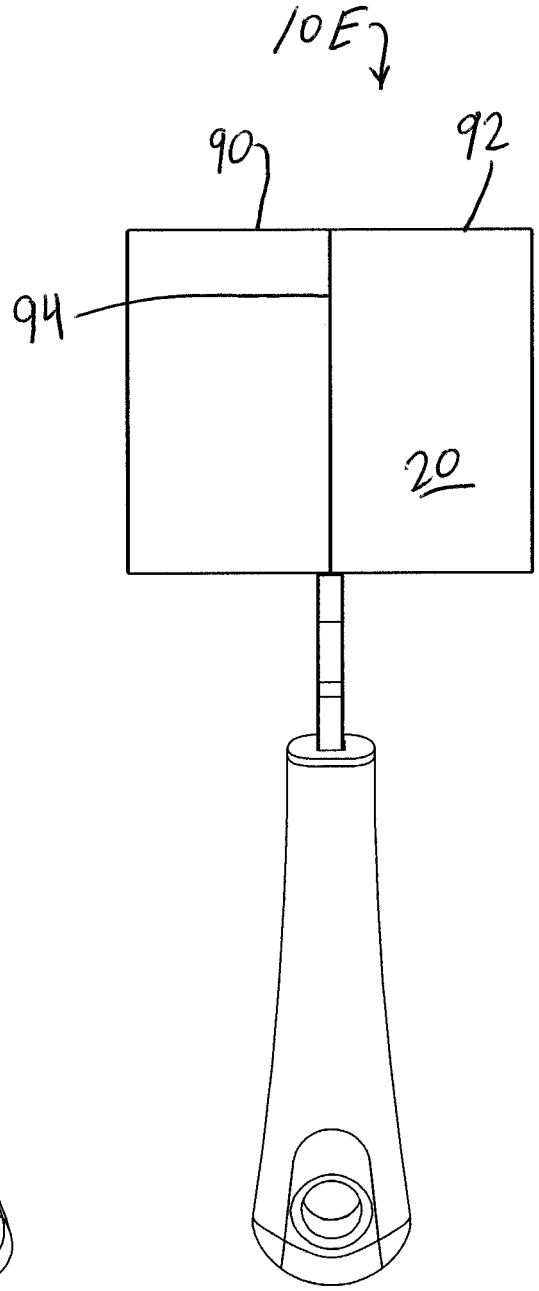
Figure 32:
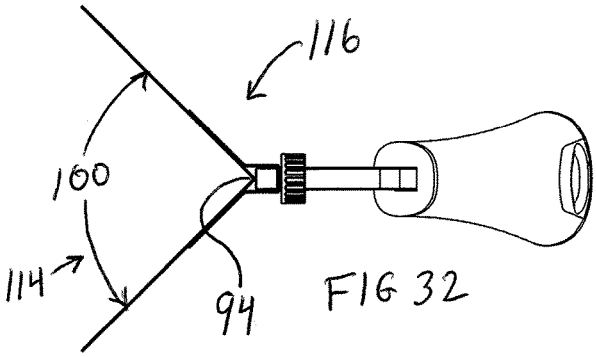
Figure 33:
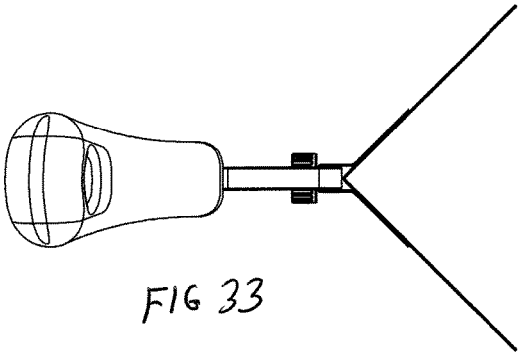
Figure 34:
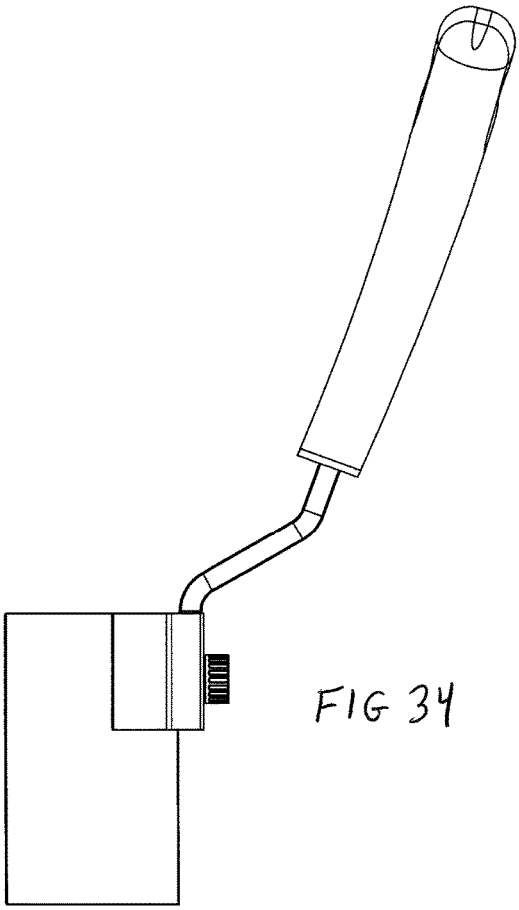

With simultaneous reference to FIG. 5, and FIGS. 28 through 34, addition details of external implement 20 are now described. External implement 20 includes a subsequent first end 114 comprising the aforementioned contact subsequent edge contact 94 and a subsequent second end 116 which includes the aforementioned angle 100. Contained within the subsequent second end 116 is a housing 96. Housing 96 includes a subsequent first fold 106 and a subsequent second fold 108. Subsequent first and second folds 106/108 are symmetrical along the center of housing 96 and compliment angle 100 to allow for housing 96 to mate along the subsequent second end 116 of external implement 20. Housing 96 is attached along the subsequent second end 116 using a plurality of spot welds. The forming of subsequent first and second folds 106/108 form the opening 110 along the central portion of housing 96. Opening 110 is complementary is shape to that of extension 28 to allow for extension 28 to pass through opening 110. Along the length of opening 110 is a hole 112. It should be noted that instead of utilizing a plurality of spot welds to attach housing 96 to form opening 110, opening 110 can be formed integral (single component) such as a single molded component or a single machined component with opening 110 included thereto. Subsequent first edge 90 and subsequent second edge 92 of external implement 20 are coplanar when orientated along the side. As illustrated in FIGS. 29, 31, and 34.

External implement 20 is removably secured to handle assembly 12 in the same manner as with respect to internal implement 14. The details of securing external implement 20 to handle assembly 12 is briefly describe with reference to the similar details of internal implement 14. Extension 28 of handle assembly 12 is inserted into opening 110 formed along the assembly of housing 96. Once extension 28 is inserted into opening 110, the threaded hole 70 is aligned to hole 112 of housing 58. Hole 112 allows for retainer 16, more specifically threaded shaft 74 of retainer 16 to pass therethrough and engage threaded hole 70 of extension 28. Once threaded shaft 74 is engaged to threaded hole 70, retainer 16 can be secured by grasping and rotating body 72 of retainer 16 and forming a tight threaded connection. When it is desired to remove external implement 20 from handle assembly 12, the steps are repeated in the reverse. More specifically, the threaded connection of threaded shaft 74 of retainer 16 to threaded hole 70 of extension 28 is removed so that retainer 16 can be removed. This allows for external implement 20 to be removed from handle assembly 12.

It should be noted that in addition to handle assembly 12 accepting internal implement 14 and external implement 20, both configured for use on internal and external corners respectively, handle assembly 12 can find use with other style implements. In one example, a taping knife can be configured for securement onto handle assembly 12. In another example, a first style putty knife can be configured for securement onto handle assembly 12. In yet another example, a scraper can be configured for securement onto handle assembly 12. Those having skill in the art can appreciate that any sundry tool portion can be secured to handle assembly 12.

It should also be noted that the terms "first", "second", "third", "upper", "lower", and the like may be used herein to modify various elements. These modifiers do not imply a spatial, sequential, or hierarchical order to the modified elements unless specifically stated.

While the present disclosure has been described with reference to one or more exemplary embodiments, it will be understood by those skilled in the art that various changes may be made and equivalents may be substituted for elements thereof without departing from the scope of the present disclosure. In addition, many modifications may be made to adapt a particular situation or material to the teachings of the disclosure without departing from the scope thereof. Furthermore, it should be understood that there is no intention to limit this disclosure to specific forms disclosed, but on the contrary, the intention is to cover all modifications, alternative constructions, and the equivalents falling within the spirit and scope of this disclosure. Therefore, it is intended that the present disclosure not be limited to the particular embodiment(s) disclosed as the best mode contemplated, but that the disclosure will include all embodiments falling within the scope of the disclosure.

It should be noted that the various features as described by reference to tool 10 can be selectively altered to create different products. For example, the use of a threaded connection to secure the implements to the handle assembly can be substituted with a variety of alternatives such as and not limited to snap fits, quarter turn fasteners, magnetic connections, etc.

What is claimed is:

1. A versatile compound tool comprising:

a handle assembly having a proximal end and a distal end, the handle assembly including a gripping surface along the proximal end and an extension extending from the gripping surface along the distal end, the extension including a first portion fixed to the gripping surface, a second portion extending from the first portion and having a first angle relative to the first portion, and a third portion extending from the second portion and having a second angle relative to the second portion, the first and second angles forming an offset between the third portion and the gripping surface, the third portion including a first connection feature;

a first implement having a front side, a back side, a proximal end, and a distal end, the first implement configured for a first function along the front side, the first implement further including a housing having an opening along the central portion of the housing and integrated to the back side of the proximal end of the first implement, the opening including a second connection feature and configured for receiving the third portion of the extension;

a retainer;

wherein the first implement is removably securable to the handle assembly by the retainer along the back side of the first implement when the first connection feature is engaged to the second connection feature so that the retainer is positioned along the opposite side of the first function, the versatile compound tool configured so that the first implement is selectively removable for receiving a second implement for performing a second function;

wherein the first connection feature is a threaded hole, the second connection feature is a clearance hole, and the retainer comprises a threaded shaft insertable through the clearance hole and engageable to the threaded hole when the first and second retainers are aligned for securing the first or second implement to the handle assembly.

2. The versatile compound tool of claim 1, the second implement further comprising:

a front side, a back side, a proximal end, and a distal end, the second implement configured for a second function along the front side of the second implement, the second implement further including a housing having an opening along the central portion of the housing and integrated to the back side of the proximal end of the second implement, the opening including a second connection feature and configured for receiving the third portion of the extension;

wherein the second implement is removably securable to the handle assembly by the retainer along the back side of the second implement when the first connection feature is engaged to the second connection feature so that the retainer is positioned along the opposite side of the second function.

3. The versatile compound tool of claim 2 wherein the second function is for forming compound along an external corner.

4. The versatile compound tool of claim 2, wherein the first or second function is for forming compound along a flat surface.

5. The versatile compound tool of claim 2, wherein the first and second implements are fabricated in stainless steel, plated carbon steel, aluminum, plastic, metal, and any combinations thereof.

6. The versatile compound tool of claim 1, wherein the first function is for forming compound along an internal corner.

7. The versatile compound tool of claim 1, wherein the offset from the extension extending from the handle assembly defines a clearance from the gripping surface to the front surface of the first or second implement to facilitate the grasping of the gripping surface by a user.

8. The versatile compound tool of claim 1, wherein the extension forming the first connection feature extending from the handle comprises a square cross section and is engageable to a complimentary square opening along the first or second implement.

9. The versatile compound tool of claim 1, wherein the handle assembly is fabricated in stainless steel, plated carbon steel, aluminum, plastic, metal, rubber, and any combinations thereof.

10. A versatile compound tool comprising:

a handle assembly having a proximal end and a distal end, the handle assembly including a gripping surface along the proximal end and an extension extending from the gripping surface along the distal end, the extension including a first portion fixed to the gripping surface, a second portion extending from the first portion and having a first angle relative to the first portion, and a third portion extending from the second portion and having a second angle relative to the second portion, the first and second angles forming an offset between the third portion and the gripping surface, the third portion including a first connection feature;

a plurality of implements each having a front side, a back side, a proximal end, and a distal end, each implement configured for a specific function along the front side, each implement further including a housing having an opening along the central portion of the housing and integrated to the back side of the proximal end of the implements, the opening including a second connection feature and configured for receiving the third portion of the extension;

a retainer;

wherein each implement is removably securable to the handle assembly by the retainer along the back side of each implement when the first connection feature is engaged to the second connection feature so that the retainer is positioned along the opposite side of the specific functions of the implements, the versatile compound tool configured so that each implement is selectively removable for receiving an alternate implement;

wherein the first connection feature is a threaded hole, the second connection feature is a clearance hole, and the retainer comprises a threaded shaft insertable through the clearance hole and engageable to the threaded hole when the first and second retainers are aligned for securing the first or second implement to the handle assembly.

11. The versatile compound tool of claim 10, wherein one of the plurality of implements is configured for forming compound in an internal corner.

12. The versatile compound tool of claim 10, wherein the one of the plurality of implements is configured for forming compound on an external corner.

13. The versatile compound tool of claim 10, wherein the one of the plurality of implements is configured for forming compound on a flat surface.

14. The versatile compound tool of claim 10, wherein the extension forming the first connection feature extending from the handle comprises a square cross section and is sized to fit within a complimentary opening along the implements.

15. The versatile compound tool of claim 10, wherein the handle assembly is fabricated in stainless steel, plated carbon steel, aluminum, plastic, metal, rubber, and any combinations thereof.

16. The versatile compound tool of claim 10, wherein the implements are fabricated in stainless steel, plated carbon steel, aluminum, plastic, metal, and any combinations thereof.

17. A versatile compound tool comprising:

a handle assembly having a proximal end and a distal end, the handle assembly including a gripping surface along the proximal end and an extension extending from the gripping surface along the distal end, the extension including a first portion fixed to the gripping surface, a second portion extending from the first portion and having a first angle relative to the first portion, and a third portion extending from the second portion and having a second angle relative to the second portion, the first and second angles forming an offset between the third portion and the gripping surface, the third portion including a first connection feature;

a first implement having a front side, a back side, a proximal end, and a distal end, the first implement configured for a first function along the front side, the first implement further including a housing having an opening along the central portion of the housing and integrated to the back side of the proximal end of the first implement, the opening including a second connection feature and configured for receiving the third portion of the extension;

a retainer;

wherein the first implement is removably securable to the handle assembly by the retainer along the back side of the first implement when the first connection feature is engaged to the second connection feature so that the retainer is positioned along the opposite side of the first function, the versatile compound tool configured so that the first implement is selectively removable for receiving a second implement, the second implement including:

a front side, a back side, a proximal end, and a distal end, the second implement configured for a second function along the front side of the second implement, the second implement further including a housing having an opening along the central portion of the housing and attached to the back side of the proximal end of the second implement, the opening including a second connection feature and configured for receiving the third portion of the extension;

wherein the second implement is removably securable to the handle assembly by the retainer along the back side of the second implement when the first connection feature is engaged to the second connection feature so that the retainer is positioned along the opposite side of the second function;

wherein the first connection feature is a threaded hole, the second connection feature is a clearance hole, and the retainer comprises a threaded shaft insertable through the clearance hole and engageable to the threaded hole when the first and second retainers are aligned for securing the first or second implement to the handle assembly.

18. The versatile compound tool of claim 17, wherein the first and second implements are fabricated in stainless steel, plated carbon steel, aluminum, plastic, metal, and any combinations thereof.

* * * * *